US009127383B2

(12) United States Patent
Yamanashi et al.

(10) Patent No.: US 9,127,383 B2
(45) Date of Patent: Sep. 8, 2015

(54) SEWING MACHINE AND NON-TRANSITORY COMPUTER-READABLE MEDIUM

(71) Applicants: Yoko Yamanashi, Konan (JP); Mika Matsushima, Ichinomiya (JP); Masayuki Hori, Gifu (JP)

(72) Inventors: Yoko Yamanashi, Konan (JP); Mika Matsushima, Ichinomiya (JP); Masayuki Hori, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 238 days.

(21) Appl. No.: 13/912,712

(22) Filed: Jun. 7, 2013

(65) Prior Publication Data

US 2014/0000498 A1 Jan. 2, 2014

(30) Foreign Application Priority Data

Jun. 27, 2012 (JP) ..... 2012-144266

(51) Int. Cl.
*D05B 19/12* (2006.01)
*D05C 5/02* (2006.01)

(52) U.S. Cl.
CPC . *D05B 19/12* (2013.01); *D05C 5/02* (2013.01)

(58) Field of Classification Search
CPC ..... D05C 9/04; D05C 9/22; D05C 5/02
USPC ..... 700/138, 137, 136; 112/470.01, 470.03, 112/470.04, 470.05, 470.06
See application file for complete search history.

(56) References Cited

U.S. PATENT DOCUMENTS

| | | | | |
|---|---|---|---|---|
| 3,966,331 | A | 6/1976 | Inuiya | |
| 4,712,497 | A * | 12/1987 | Nomura et al. | 112/315 |
| 4,998,489 | A * | 3/1991 | Hisatake et al. | 112/103 |
| 5,072,680 | A | 12/1991 | Nakashima | |
| 5,195,451 | A | 3/1993 | Nakashima | |
| 5,553,559 | A * | 9/1996 | Inoue et al. | 112/102.5 |

(Continued)

FOREIGN PATENT DOCUMENTS

| | | |
|---|---|---|
| JP | A-3-234283 | 10/1991 |
| JP | A-5-15667 | 1/1993 |

(Continued)

OTHER PUBLICATIONS

U.S. Appl. No. 13/788,903, filed Mar. 7, 2013 in the name of Yoshio Nishimura.

(Continued)

*Primary Examiner* — Danny Worrell
(74) *Attorney, Agent, or Firm* — Oliff PLC

(57) ABSTRACT

A sewing machine includes a position acquisition device, a projection device, a processor, and a memory. The position acquisition device is configured to acquire information describing at least one designated position, each of the at least one designated position being a position on a sewing workpiece. The projection device is configured to project an image onto the sewing workpiece. The memory is configured to store non-transitory computer-readable instructions that instruct the processor to execute a step that includes specifying the at least one designated position on the sewing workpiece described by the information acquired by the position acquisition device. The memory is also configured to store non-transitory computer-readable instructions that instruct the processor to execute a step that includes causing the projection device to project a visually recognizable marker onto the sewing workpiece, based on the specified at least one designated position.

10 Claims, 12 Drawing Sheets

(56) References Cited

U.S. PATENT DOCUMENTS

| | | | | |
|---|---|---|---|---|
| 5,855,176 | A * | 1/1999 | Takenoya et al. | 112/102.5 |
| 6,000,350 | A * | 12/1999 | Koike et al. | 112/102.5 |
| 6,167,822 | B1 * | 1/2001 | Miyasako et al. | 112/102.5 |
| 6,871,606 | B2 * | 3/2005 | Schweizer | 112/475.02 |
| 6,883,446 | B2 | 4/2005 | Koerner | |
| 7,079,917 | B2 * | 7/2006 | Taguchi et al. | 700/138 |
| 7,155,302 | B2 * | 12/2006 | Muto et al. | 700/138 |
| 7,373,891 | B2 * | 5/2008 | Koerner | 112/475.02 |
| 7,854,207 | B2 * | 12/2010 | Kuki et al. | 112/102.5 |
| 8,061,286 | B2 | 11/2011 | Hirata et al. | |
| 8,074,590 | B2 | 12/2011 | Bentley | |
| 8,286,568 | B2 * | 10/2012 | Tokura | 112/102.5 |
| 8,301,292 | B2 * | 10/2012 | Tokura | 700/138 |
| 8,567,329 | B2 | 10/2013 | Kishi | |
| 8,763,542 | B2 | 7/2014 | Abe et al. | |
| 2004/0182295 | A1 * | 9/2004 | Pfeifer | 112/119 |
| 2009/0188413 | A1 | 7/2009 | Hirata et al. | |
| 2011/0048299 | A1 * | 3/2011 | Tokura | 112/102.5 |
| 2011/0226170 | A1 | 9/2011 | Tokura | |
| 2012/0000249 | A1 * | 1/2012 | Hamada | 65/424 |
| 2012/0111249 | A1 * | 5/2012 | Sekine | 112/102.5 |
| 2012/0210925 | A1 * | 8/2012 | Koga et al. | 112/470.04 |
| 2013/0233217 | A1 * | 9/2013 | Shimizu et al. | 112/102.5 |
| 2013/0233219 | A1 | 9/2013 | Nakamura et al. | |
| 2013/0233220 | A1 | 9/2013 | Nomura et al. | |
| 2013/0233221 | A1 | 9/2013 | Abe et al. | |
| 2013/0233222 | A1 | 9/2013 | Nishimura et al. | |
| 2014/0000498 | A1 | 1/2014 | Yamanashi et al. | |

FOREIGN PATENT DOCUMENTS

| | | |
|---|---|---|
| JP | A-2009-172123 | 8/2009 |
| JP | A-2011-194043 | 10/2011 |

OTHER PUBLICATIONS

Office Action issued in U.S. Appl. No. 13/788,903 dated Jul. 30, 2014.

* cited by examiner

SEWING MACHINE AND NON-TRANSITORY COMPUTER-READABLE MEDIUM

CROSS-REFERENCE TO RELATED APPLICATION

This application claims priority to Japanese Patent Application No. 2012-144266 filed Jun. 27, 2012, the content of which is hereby incorporated herein by reference in its entirety.

BACKGROUND

The present disclosure relates to a sewing machine and a non-transitory computer-readable medium.

A sewing machine is known that is capable of easily setting a sewing position and a sewing angle, at which a desired embroidery pattern is to be sewn, on a work cloth. For example, after a user affixes a marker to a specified position on the work cloth, the sewing machine uses an image capture device to capture an image of the marker. The sewing machine may automatically set the sewing position and the sewing angle of the embroidery pattern based on the captured image of the marker.

SUMMARY

With the sewing machine that is described above, once the user has detached the marker from the work cloth, the user is not able to check how the sewing position and the sewing angle have been set on the work cloth.

Embodiments of the broad principles derived herein provide a sewing machine and a non-transitory computer-readable medium that enable the user to easily check a state of designation of a position on a sewing workpiece.

Embodiments provide a sewing machine that includes a position acquisition device, a projection device, a processor, and a memory. The position acquisition device is configured to acquire information describing at least one designated position, each of the at least one designated position being a position on a sewing workpiece. The projection device is configured to project an image onto the sewing workpiece. The memory is configured to store non-transitory computer-readable instructions that instruct the processor to execute a step that includes specifying the at least one designated position on the sewing workpiece described by the information acquired by the position acquisition device. The memory is also configured to store non-transitory computer-readable instructions that instruct the processor to execute a step that includes causing the projection device to project a visually recognizable marker onto the sewing workpiece, based on the specified at least one designated position.

embodiments also provide a non-transitory computer-readable medium storing computer-readable instructions. The computer-readable instructions includes computer-readable instructions, when executed, to cause the sewing machine to perform the step of specifying at least one designated position on a sewing workpiece described by information acquired by a position acquisition device of the sewing machine, the position acquisition device being configured to acquire the information describing the designated position, each of the at least one designated position being a position on a sewing workpiece. The computer-readable instructions also includes computer-readable instructions, when executed, to cause the sewing machine to perform the step of causing a projection device provided to the sewing machine to project a visually recognizable marker onto the sewing workpiece, based on the specified at least one designated position, the projection device being configured to project an image onto the sewing workpiece.

BRIEF DESCRIPTION OF THE DRAWINGS

Embodiments will be described below in detail with reference to the accompanying drawings in which.

DETAILED DESCRIPTION

Figure 1:
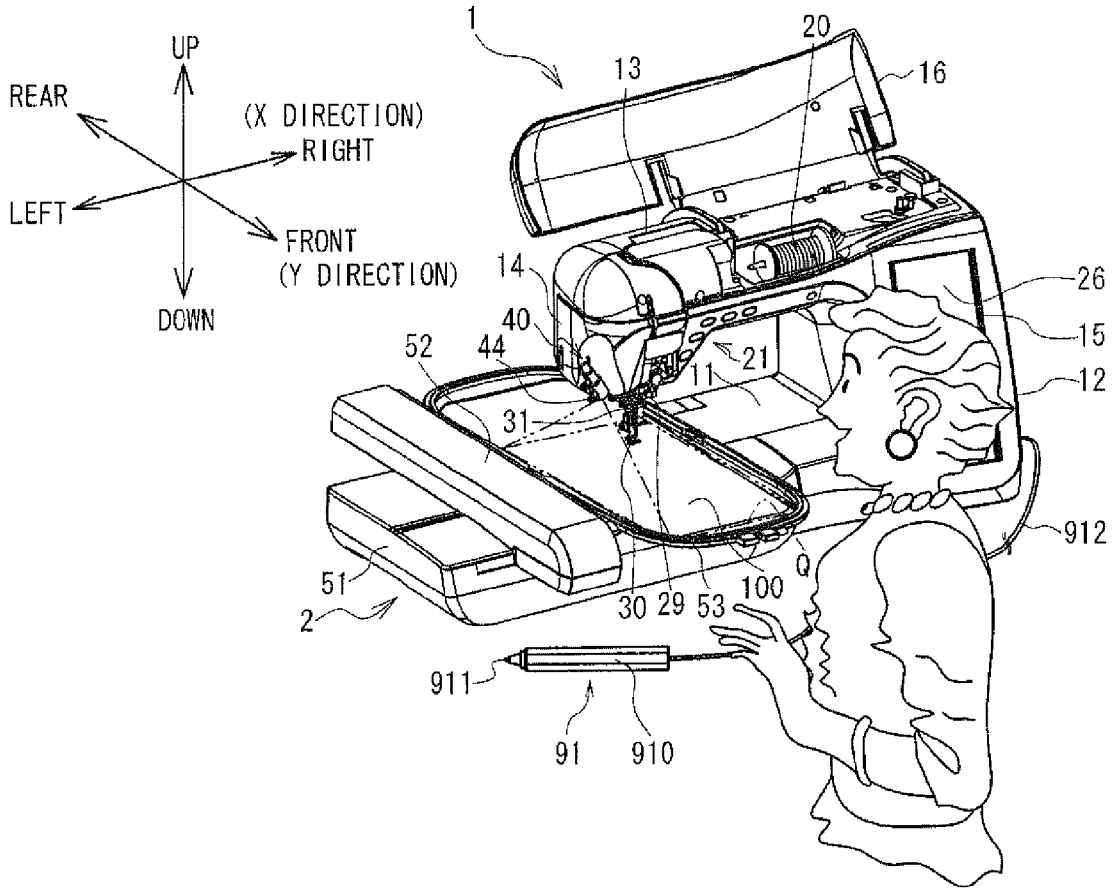
FIG. 1 is an oblique view of a sewing machine.

Hereinafter, first and second embodiments of the present disclosure will be explained in order with reference to the drawings.

A physical configuration of a sewing machine 1 that is common to the first and the second embodiments will be explained with reference to FIGS. 1 to 6. The front side, the rear side, the top side, the bottom side, the left side, and the right side in FIG. 2 respectively define the front side, the rear side, the top side, the bottom side, the left side, and the right side of the sewing machine 1.

The sewing machine 1 includes the bed 11, the pillar 12, and the arm 13. The bed 11 is a base portion of the sewing machine 1 and extends in the left-right direction. The pillar 12 extends upward from the right end of the bed 11. The arm 13 extends to the left from the upper end of the pillar 12 such that the arm 13 faces the bed 11. The left end of the arm 13 is a head 14. A needle plate 34 is disposed on a top surface of the bed 11. A feed dog, a feed mechanism, a shuttle mechanism (which are not shown in the drawings) and a feed adjustment motor 83 (refer to FIG. 7) are provided below the needle plate 34 (namely, inside the bed 11). The feed dog may be driven by the feed mechanism, and may feed a sewing workpiece (for example, a work cloth) by a specified feed distance. The feed adjustment motor 83 may adjust the feed distance of the feed dog.

A needle bar 29 and a presser bar 31 extend downward from the lower edge of the head 14. A sewing needle 28 may be replaceably attached to the lower end of the needle bar 29. A presser foot 30 may be replaceably attached to the lower end of the presser bar 31. The presser foot 30 may press on a sewing workpiece 100. A needle bar mechanism (not shown in the drawings), a swinging mechanism (not shown in the drawings), a swinging motor 80 (refer to FIG. 7), and the like are provided in the head 14 as a sewing mechanism 89 (refer to FIG. 7). The sewing mechanism 89 is configured to form a stitch in the sewing workpiece. The needle bar mechanism is configured to drive the needle bar 29 up and down. A sewing machine motor 79 (refer to FIG. 7) may drive the needle bar mechanism. The swinging mechanism is configured to swing the needle bar 29 in the left-right direction. The swinging mechanism may be driven by the swinging motor 80.

Receivers 94, 95 are provided on the rear portion of the lower end of the head 14. The receiver 94 and the receiver 95 have the identical structures. The receiver 94 is provided on the rear part of the bottom face of the head 14 at the lower left edge of the head 14. The receiver 95 is provided on the rear part of the bottom face of the head 14 at the lower right edge of the head 14. The receivers 94, 95 are separated from one another by the length of the head 14 in the left-right direction. The receivers 94, 95 are configured to detect ultrasonic waves. The receivers 94, 95 will be described in detail below.

Figure 2:
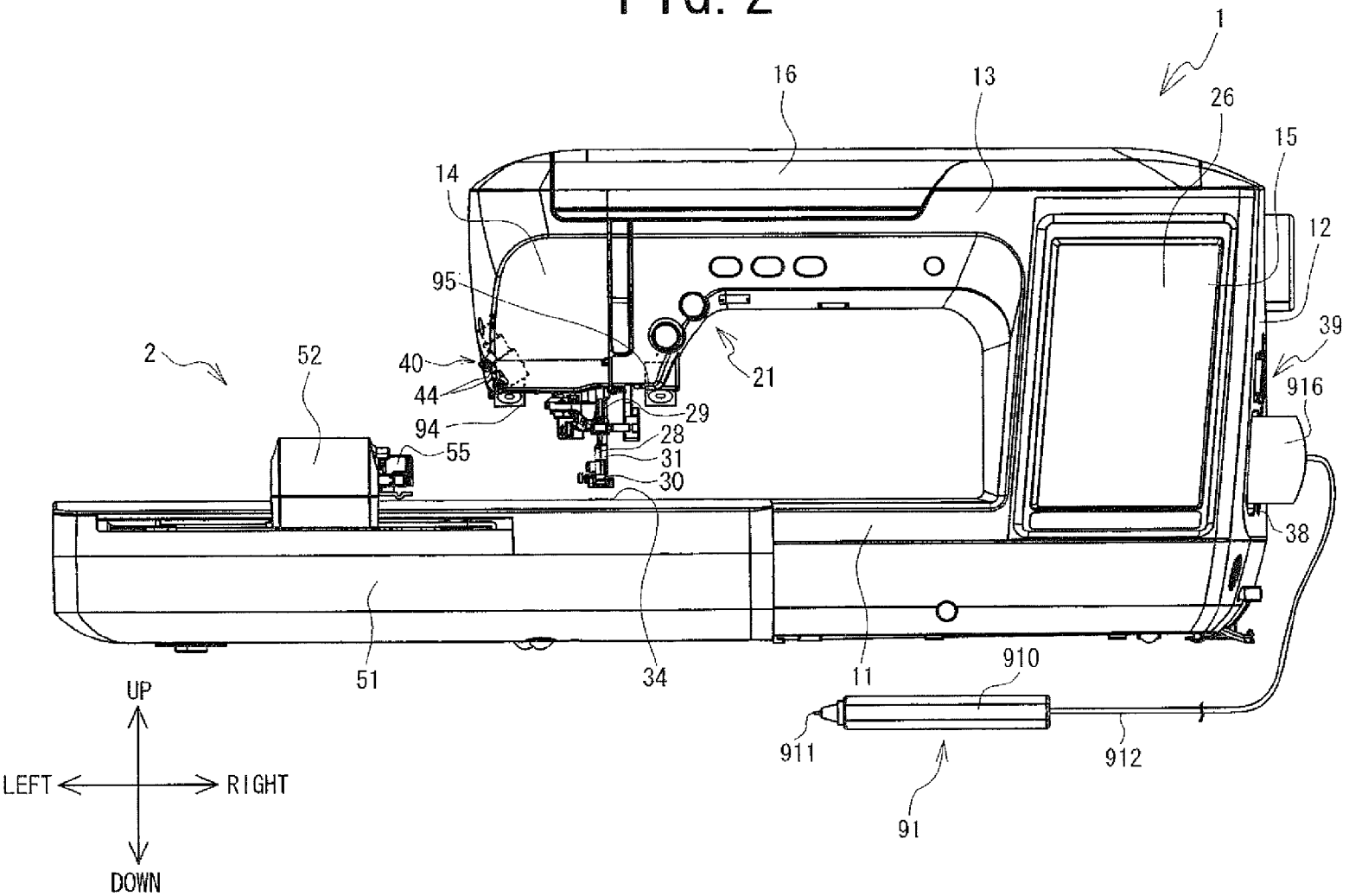
FIG. 2 is a front view of the sewing machine.

A projector 40 that is configured to project an image onto the sewing workpiece 100 is attached to the left front portion of the head 14. The greater part of the projector 40 is contained in the interior of the head 14, but a pair of adjusting screws 44 project to the outside of the head 14, as shown in FIG. 2. The adjusting screws 44 are screws that may respectively adjust the size and the focal point of the image to be projected (hereinafter called the projection image). The projector 40 may project the image into a specified projection range Q on the bed 11. The projector 40 will be described in detail below.

A cover 16 to be opened and closed is provided on an upper portion of the arm 13. A thread spool (not shown in the drawings) may be accommodated underneath the cover 16, that is, substantially in a central portion within the arm 13. An upper thread (not shown in the drawings) may be wound around the thread spool. The upper thread may be supplied from the thread spool, through a thread hook (not shown in the drawings), to the sewing needle 28 attached to the needle bar 29. The thread hook is provided on the head 14. The operation switches 21 are provided in the lower portion of the front face of the arm 13. The operation switches 21 include a start-and-stop switch.

A liquid crystal display (hereinafter called the LCD) 15 is provided on the front face of the pillar 12. A screen that includes various types of items, such as commands, illustrations, setting values, messages, and the like, may be displayed on the LCD 15. A touch panel 26 is provided on the front face side of the LCD 15. When a user performs an operation of pressing on the touch panel 26 by using a finger or a special stylus pen, the item that corresponds to the position where the pressure is detected by the touch panel 26 is recognized as having been selected. Hereinafter, an operation of pressing on the touch panel 26 will be called a panel operation. By performing this sort of panel operation, the user can select a pattern to be sewn and a command to be executed.

Connectors 38 and 39 are provided on a right surface of the pillar 12. An external storage device (not shown in the drawings), such as a memory card, can be connected to the connector 39. The sewing machine 1 may read out pattern data and various programs from the external storage device connected to the connector 39. A connector 916 may be connected to the connector 38. The connector 916 is coupled to a cable 912 that extends from an ultrasonic pen 91 which will be described below. The sewing machine 1 may supply electric power to the ultrasonic pen 91 via the connector 38, the connector 916, and the cable 912, and may acquire an electrical signal output from the ultrasonic pen 91.

The sewing machine 1 also includes an embroidery device 2. The embroidery device 2 can be mounted on and removed from the bed 11 of the sewing machine 1. When the embroidery device 2 is mounted on the sewing machine 1, the embroidery device 2 and the sewing machine 1 are electrically connected. In a case where the embroidery device 2 and the sewing machine 1 are electrically connected, the embroidery device 2 may function as a part of the sewing mechanism 89 (refer to FIG. 7) of the sewing machine 1. The embroidery device 2 includes a body 51 and a carriage 52.

The carriage 52 is provided on the top side of the body 51. The carriage 52 has a rectangular shape that is long in the front-rear direction. The carriage 52 includes a frame holder 55, a Y axis moving mechanism (not shown in the drawings), and a Y axis motor 87 (refer to FIG. 7). The frame holder 55 is a holder on which an embroidery frame 53 (refer to FIG. 1) can be removably mounted. An embroidery frame of a size and shape that are different from those of the embroidery frame 53 can also be mounted on and removed from the frame holder 55. The frame holder 55 is provided on the right side face of the carriage 52. As shown in FIG. 1, the embroidery frame 53 has a known structure. The embroidery frame 53 is configured to hold the sewing workpiece 100 by clamping the sewing workpiece 100 between an inner frame and an outer frame, although this is not shown in detail in the drawings. The sewing workpiece 100 that is held in the embroidery frame 53 may be positioned on the top side of the bed 11 and below the needle bar 29 and the presser foot 30. The Y axis moving mechanism is configured to move the frame holder 55 in the front-rear direction (the Y direction). The moving of the frame holder 55 in the front-rear direction causes the embroidery frame 53 to move the sewing workpiece 100 in the front-rear direction. The Y axis motor 87 may drive the Y axis moving mechanism. A CPU 61 (refer to FIG. 7) of the sewing machine 1 may control the Y axis motor 87.

An X axis moving mechanism (not shown in the drawings) and an X axis motor 86 (refer to FIG. 7) that may move the carriage 52 in the left-right direction (the X direction) are provided in the interior of the body 51. The moving of the carriage 52 in the left-right direction causes the embroidery frame 53 to move the sewing workpiece 100 in the left-right direction. The X axis motor 86 may drive the X axis moving mechanism. The CPU 61 of the sewing machine 1 may control the X axis motor 86.

The ultrasonic pen 91 will be explained. The ultrasonic pen 91 includes a pen body 910 and a pen tip 911. The shape of the pen body 910 is a bar shape. The pen tip 911 is provided on one end of the pen body 910. The tip of the pen tip 911 is pointed. The pen tip 911 is able to move between a projecting position and a retracted position. The projecting position is a position in which the pen tip 911 projects slightly to the outside of the pen body 910. In a state in which an external force is not acting on the pen tip 911, the pen tip 911 is positioned in the projecting position. When a force acts on the pen tip 911 that is in the projecting position in the direction toward the pen body 910 side, the pen tip 911 moves into the pen body 910, and the pen tip 911 shifts to the retracted position. When the force that is acting on the pen tip 911 ceases, the pen tip 911 returns to the projecting position.

A switch 913 (refer to FIG. 7), a signal output circuit 914 (refer to FIG. 7), and an ultrasonic transmitter 915 (refer to FIG. 7) are provided inside the pen body 910. The switch 913 may switch between an ON state and an OFF state in accordance with the position of the pen tip 911. The switch 913 may switch the output states of the signal output circuit 914 and the ultrasonic transmitter 915.

When the pen tip 911 is positioned in the projecting position, the switch 913 is in the OFF state. In a case where the switch 913 is in the OFF state, the signal output circuit 914 does not output an electrical signal, and the ultrasonic transmitter 915 does not transmit ultrasonic waves. The pen tip 911 is shifted to the retracted position by the user's pressing of the pen tip 911 against a position on the sewing workpiece 100, for example. The switch 913 is switched to the ON state by the positioning of the pen tip 911 in the retracted position. When the switch 913 is in the ON state, the signal output circuit 914 outputs an electrical signal to the sewing machine 1 through the cable 912, and the ultrasonic transmitter 915 transmits ultrasonic waves.

The sewing machine 1 may use the receivers 94, 95 to detect (receive) the ultrasonic waves that are transmitted from the ultrasonic pen 91, although this will be described in detail below. Based on the detected ultrasonic waves, the sewing machine 1 may specify the position of the source of the ultrasonic waves, that is, the ultrasonic transmitter 915 that is provided in the ultrasonic pen 91. Based on the specified position, the sewing machine 1 may set at least one target sewing condition selected from among at least one sewing condition for an embroidery pattern and perform sewing. In the present embodiment, the at least one sewing condition includes the sewing position, the sewing angle, and the size of the embroidery pattern. In the first embodiment, the number of the at least one target sewing condition to be change at once is one.

The receivers 94 and 95 will be explained with reference to FIGS. 3 to 5. The receiver 95 has an identical structure to that of the receiver 94. Therefore, an explanation of the receiver 95 will be omitted. The lower left side, the upper right side, the upper left side, the lower right side, the top side, and the bottom side in FIG. 3 respectively define the front side, the rear side, the left side, the right side, the top side, and the bottom side of the receiver 94.

Figure 3:
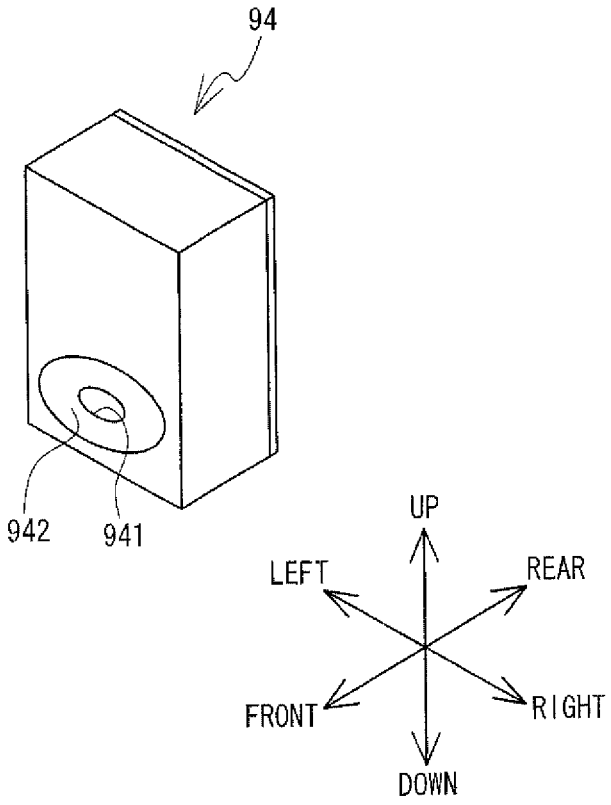
FIG. 3 is an oblique view of a receiver.
Figure 4:
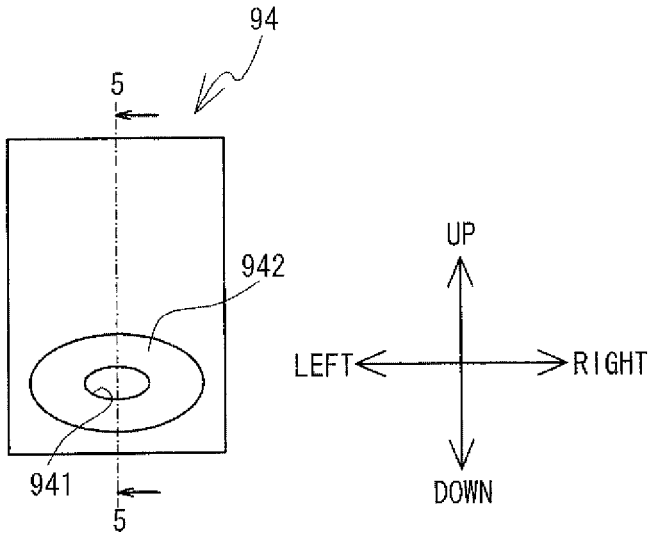
FIG. 4 is a front view of the receiver.
Figure 5:
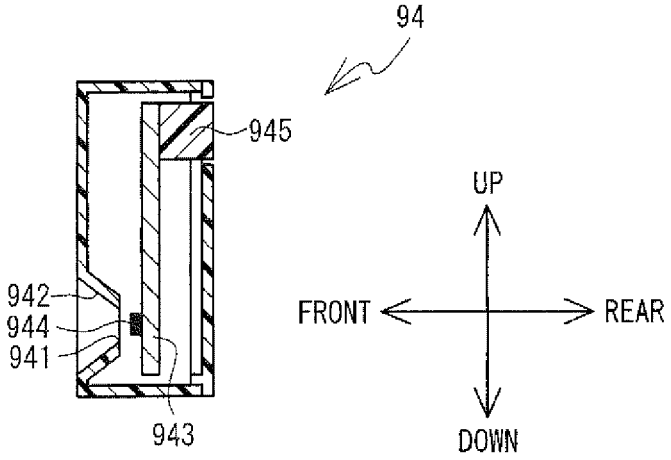
FIG. 5 is a section view of the receiver in the direction of a line 5-5 that is shown in FIG. 4.

As shown in FIGS. 3 and 4, the receiver 94 has a rectangular parallelepiped shape that is slightly longer in the up-down direction. An opening 941 is provided in the center of a lower end portion of the front face of the receiver 94. The opening 941 has an elliptical shape that is long in the left-right direction. A wall 942 around the opening 941 is a tapered surface (an inclined surface) that becomes narrower from the outer side toward the inner side of a front surface of the receiver 94. As shown in FIG. 5, a substrate 943 and a microphone 944 are provided inside the receiver 94. The microphone 944 is provided, inside the receiver 94, behind the opening 941. A connector 945 is mounted on an upper end of a rear surface of the substrate 943. The connector 945 may be connected to a connector (not shown in the drawings) that is provided on the sewing machine 1. A directionality of the receiver 94 is determined by a direction of the opening 941 in relation to the microphone 944.

Figure 6:
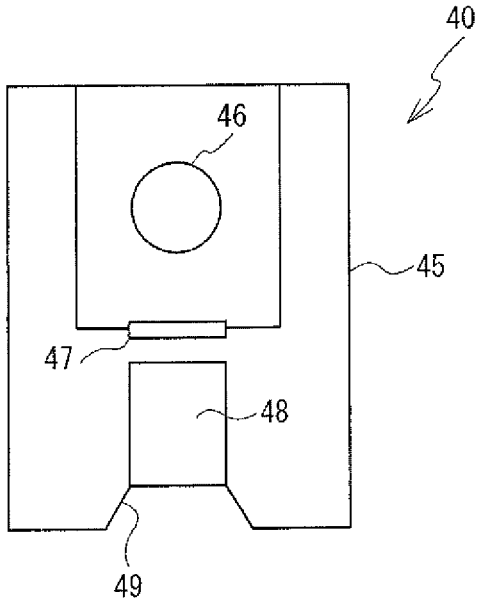
FIG. 6 is a schematic structural diagram of projector.

The projector 40 will be explained with reference to FIG. 6. As shown in FIG. 6, the projector 40 is provided with a housing 45, a light source 46, a liquid crystal panel 47, and an image-forming lens 48. In the present embodiment, the housing 45 is formed into a cylindrical shape. The housing 45 is affixed to a machine casing within the head 14, oriented to face obliquely downward toward the right rear, such that the area around a needle hole 32 (refer to FIG. 8) is positioned along the axis line of the housing 45. A metal halide type of discharge lamp, for example, can be used as the light source 46. The liquid crystal panel 47 may modulate the light from the light source 46 and, based on image data that describe the projection image, may form an image beam for the image that is to be projected. The image-forming lens 48 may cause the image beam that has been formed by the liquid crystal panel 47 to form an image in the projection range Q (refer to FIG. 1) through a projection opening 49 that is provided in the housing 45. In the present embodiment, the projector 40 is configured to project an image of a marker that indicates all of the at least one sewing condition for the embroidery pattern. Because the projector 40 projects the projection image onto the sewing workpiece obliquely from above, processing is performed on image data to correct image distortion in the projection image, although this will not be explained in detail. A coordinate system for the projection image from the projector 40 and a coordinate system for the whole of space (hereinafter called the world coordinate system) are correlated to one another in advance. It is therefore possible to correct the image data for the projector 40 based on coordinates that are expressed in the world coordinate system.

Figure 7:
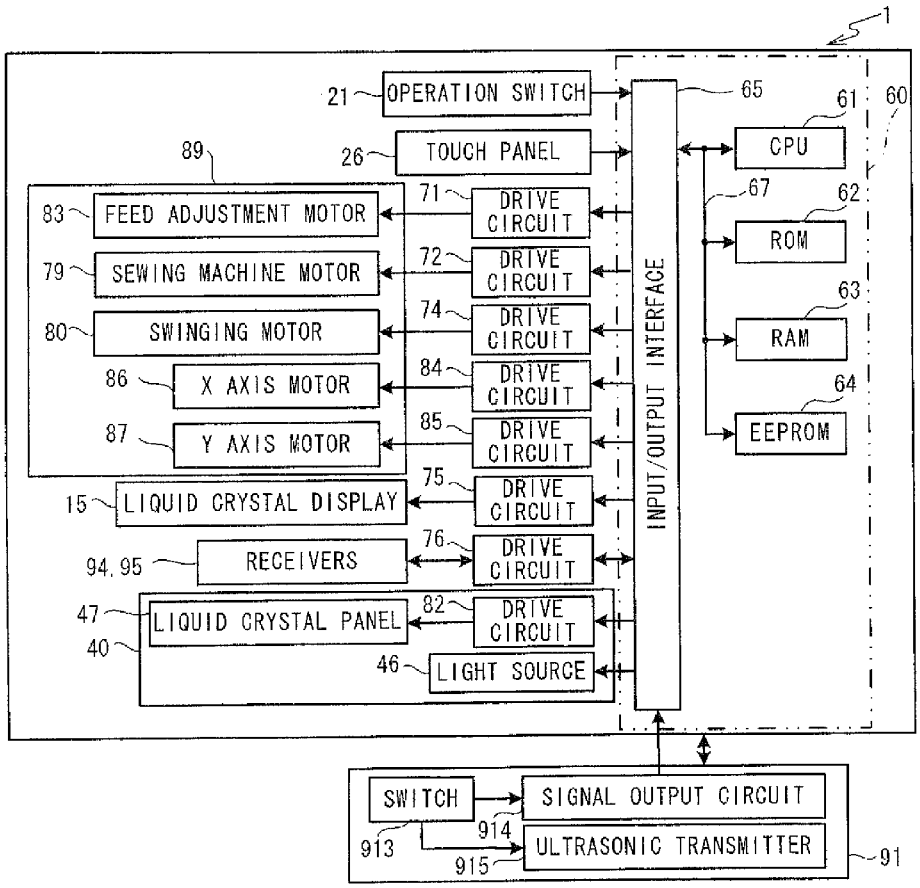
FIG. 7 is a block diagram that shows an electrical configuration of the sewing machine.

An electrical configuration of the sewing machine 1 that is common to the sewing machine 1 in the first and the second embodiments will be explained with reference to FIG. 7. A control portion 60 of the sewing machine 1 is provided with the CPU 61, a ROM 62, a RAM 63, an EEPROM 64, and an input/output interface 65. The CPU 61, the ROM 62, the RAM 63, the EEPROM 64, and the input/output interface 65 are electrically connected to one another through a bus 67. Various types of programs, including a program that the CPU 61 uses to perform main processing that will be described below, as well as data and the like, may be stored in the ROM 62. Data for a plurality of types of patterns that the sewing machine 1 uses to perform sewing, as well as various types of parameters to create the image data describing the projection image for the projector 40, and the like may be stored in the EEPROM 64.

The operation switches 21, the touch panel 26, the light source 46, and drive circuits 71, 72, 74, 75, 76, 82, 84, 85 are electrically connected to the input/output interface 65. The drive circuits 71, 72, 74, 75 may respectively drive the feed adjustment motor 83, the sewing machine motor 79, the swinging motor 80, and the LCD 15. The drive circuit 76 may drive the receivers 94, 95. An amplifier circuit is contained in the drive circuit 76. The amplifier circuit may amplify and transmit to the CPU 61 the ultrasonic wave signals that are detected by the receivers 94, 95. The drive circuits 82, 84, 85 may respectively drive the liquid crystal panel 47 of the projector 40, the X axis motor 86, and the Y axis motor 87.

The electrical configuration of the ultrasonic pen 91 will be explained. The ultrasonic pen 91 includes the switch 913, the signal output circuit 914, and the ultrasonic transmitter 915. The switch 913 is configured to be connected to the signal output circuit 914 and the ultrasonic transmitter 915. The signal output circuit 914 is connected to the input/output interface 65. The signal output circuit 914 may output electrical signals to the CPU 61 through the input/output interface 65.

Figure 8:
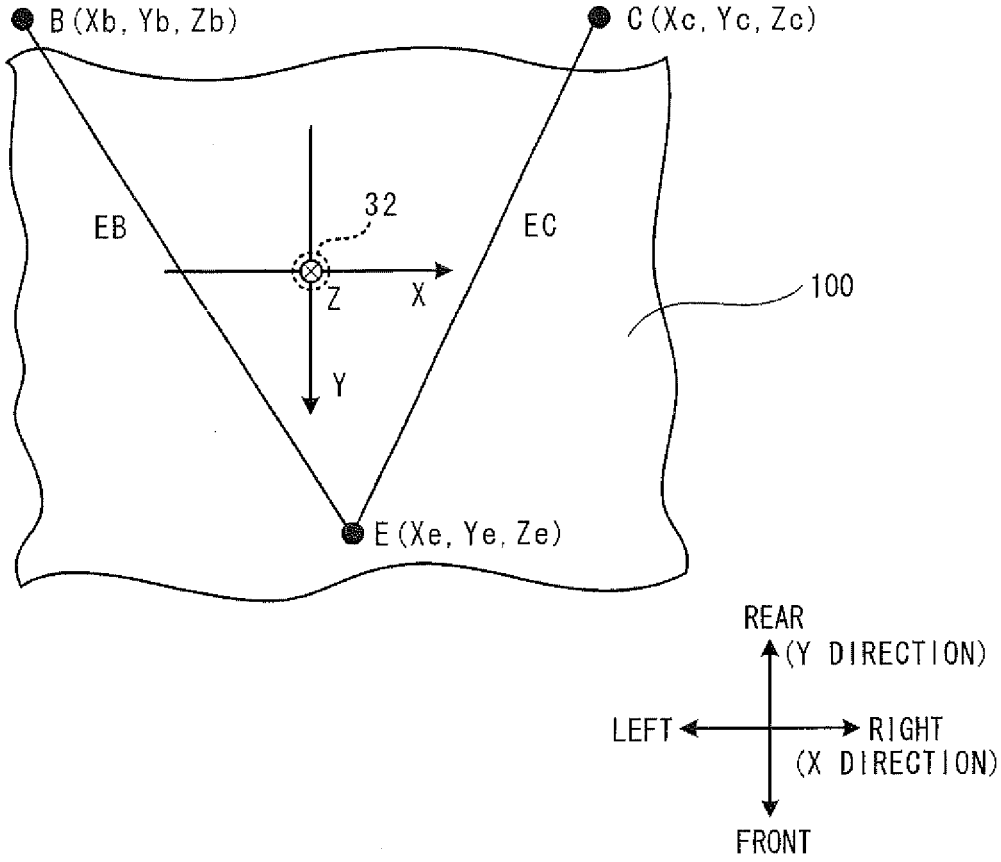
FIG. 8 is an explanatory figure of a method for computing designated coordinates E.

A method for specifying a position on the sewing workpiece 100 that the user has designated with the ultrasonic pen 91 will be explained with reference to FIGS. 1 and 8. The user may designate a position on the sewing workpiece 100 by pressing the pen tip 911 of the ultrasonic pen 91 against the sewing workpiece 100. Hereinafter, the position on the sewing workpiece 100 against which the pen tip 911 of the ultrasonic pen 91 has been pressed will be called the designated position. In the present embodiment, in a state in which the embroidery frame 53 that holds the sewing workpiece 100 has been mounted in the embroidery device 2, the designated position is located within the embroidery frame 53 and within the projection range Q of the projector 40. As will be described below, the CPU 61 of the sewing machine 1 (refer to FIG. 7) specifies the designated position by specifying the position of the transmission source of the ultrasonic waves. Therefore, strictly speaking, the position that is specified as the designated position is not the position on the sewing workpiece 100 against which the pen tip 911 is pressed, but is the position of the ultrasonic transmitter 915 that is provided in the ultrasonic pen 91. However, the pen tip 911 and the ultrasonic transmitter 915 are located extremely close to one another. Therefore, the position of the ultrasonic transmitter 915 can be regarded as the position on the sewing workpiece 100 against which the pen tip 911 is pressed, that is, as the designated position. Hereinafter, the left-right direction, the front-rear direction, and the up-down direction in the sewing machine 1 are respectively defined as the X direction, the Y direction, and the Z direction. The left-right direction and the up-down direction in FIG. 8 are respectively equivalent to the X direction and the Y direction. The direction from the front side of the page to the rear side of the page is equivalent to the Z direction.

The sewing machine 1 may specify the designated position in the form of the three-dimensional coordinate information of the world coordinate system (an X coordinate, a Y coordinate, and a Z coordinate). In the present embodiment, the origin point (0, 0, 0) of the coordinate system is the center point of a needle hole 32. The needle hole 32 is formed in the needle plate 34 (refer to FIG. 1). The needle hole 32 is a hole through which the sewing needle 28 may pass. The plane on which the Z coordinate is zero is equivalent to the top face of the needle plate 34. Coordinates B that indicate the position of the microphone 944 of the receiver 94 are defined as (Xb, Yb, Zb). Coordinates C that indicate the position of the microphone 944 of the receiver 95 are defined as (Xc, Yc, Zc). Coordinates E that indicate the designated position are defined as (Xe, Ye, Ze). The respective Z coordinates of the receivers 94, 95 indicate the heights of the microphones 944 of the receivers 94, 95 in relation to the top face of the needle plate 34. The coordinates B (Xb, Yb, Zb) and the coordinates C (Xc, Yc, Zc) are stored in the ROM 62 in advance. Hereinafter, the coordinates E are referred to as the designated coordinates E. The distance between the designated coordinates E and the coordinates B is referred to as the distance EB. The distance between the designated coordinates E and the coordinates C is referred to as the distance EC.

Based on the Pythagorean theorem, the distances EB, EC can be described by the coordinates B, C, E. The relationship between the distance EB and the coordinates B, E is described by Equation (1) below. In the same manner, the relationship between the distance EC and the coordinates C, E is described by Equation (2) below.

$$(Xb-Xe)^2+(Yb-Ye)^2+(Zb-Ze)^2=(EB)^2 \quad (1):$$

$$(Xc-Xe)^2+(Yc-Ye)^2+(Zc-Ze)^2=(EC)^2 \quad (2):$$

Equation (1) is identical to an equation for a spherical surface (with a radius of the distance EB) centered at the coordinates B with the designated coordinates E on the spherical surface. In the same manner, Equation (2) is identical to an equation for a spherical surface (with a radius of the distance EC) centered at the coordinates C with the designated coordinates E on the spherical surface.

The velocity at which ultrasonic waves travel is referred to as the velocity of sound V. The time that elapses from the time when the ultrasonic waves are transmitted from the ultrasound pen 91 that designates the designated coordinates E until the receiver 94 detects the ultrasonic waves is defined as a transmission time Tb. The time that elapses from the time when the ultrasonic waves are transmitted from the ultrasound pen 91 that designates the designated coordinates E until the receiver 95 detects the ultrasonic waves is defined as a transmission time Tc. In this case, the distances EB, EC can respectively be described by Equations (3) and (4) below.

$$EB=V\times Tb \quad (3):$$

$$EC=V\times Tc \quad (4):$$

Substituting Equations (3) and (4) into Equations (1) and (2) yields Equations (5) and (6) below.

$$(Xb-Xe)^2+(Yb-Ye)^2+(Zb-Ze)^2=(V\times Tb)^2 \quad (5):$$

$$(Xc-Xe)^2+(Yc-Ye)^2+(Zc-Ze)^2=(V\times Tc)^2 \quad (6):$$

In Equations (5) and (6), the coordinates B (Xb, Yb, Zb), the coordinates C (Xc, Yc, Zc) and the velocity of sound V are known values, and each of those values has been stored in the ROM 62 in advance. The transmission time Tb is specified by computing the difference between a transmission time T1 and a detection time T2*b*. The transmission time Tc is specified by computing the difference between the transmission time T1 and a detection time T2*c*. The transmission time T1 is the time when the ultrasonic waves are transmitted from the ultrasonic transmitter 915 of the ultrasonic pen 91. The detection times T2*b*, T2*c* are the times when the ultrasonic waves are detected by the receivers 94, 95, respectively. In the present embodiment, the embroidery device 2 does not move the embroidery frame 53 in the Z direction (the up-down direction of the sewing machine 1), so within the range in which the thickness of the sewing workpiece 100 can be disregarded, the Z coordinate for the top face of the sewing workpiece 100 may be regarded as being zero. Accordingly, the designated coordinates E (Xe, Ye, Ze (=0)) can be computed based on the simultaneous Equations (5) and (6) and on the directionalities of the receivers 94 and 95.

Figure 9:
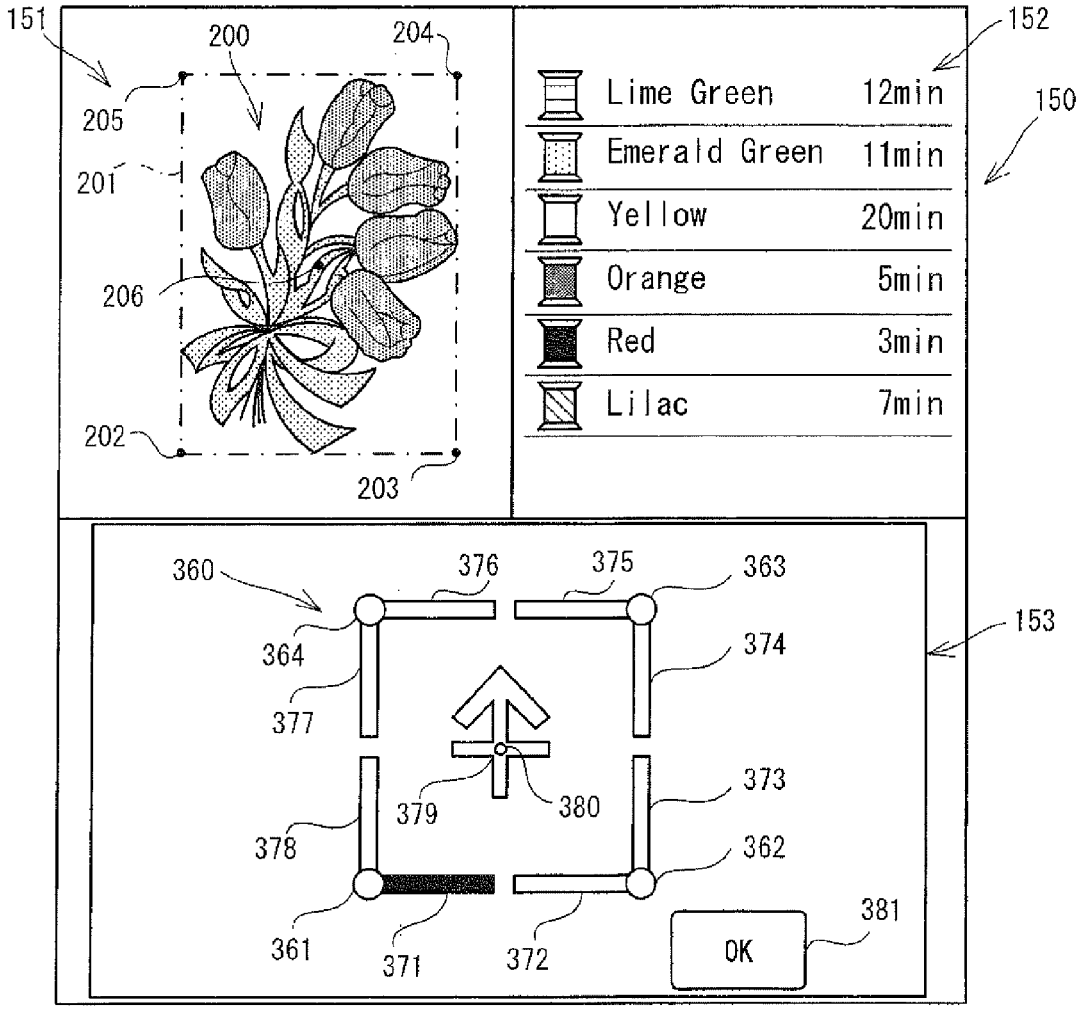
FIG. 9 is an explanatory figure of a screen.
Figure 10:
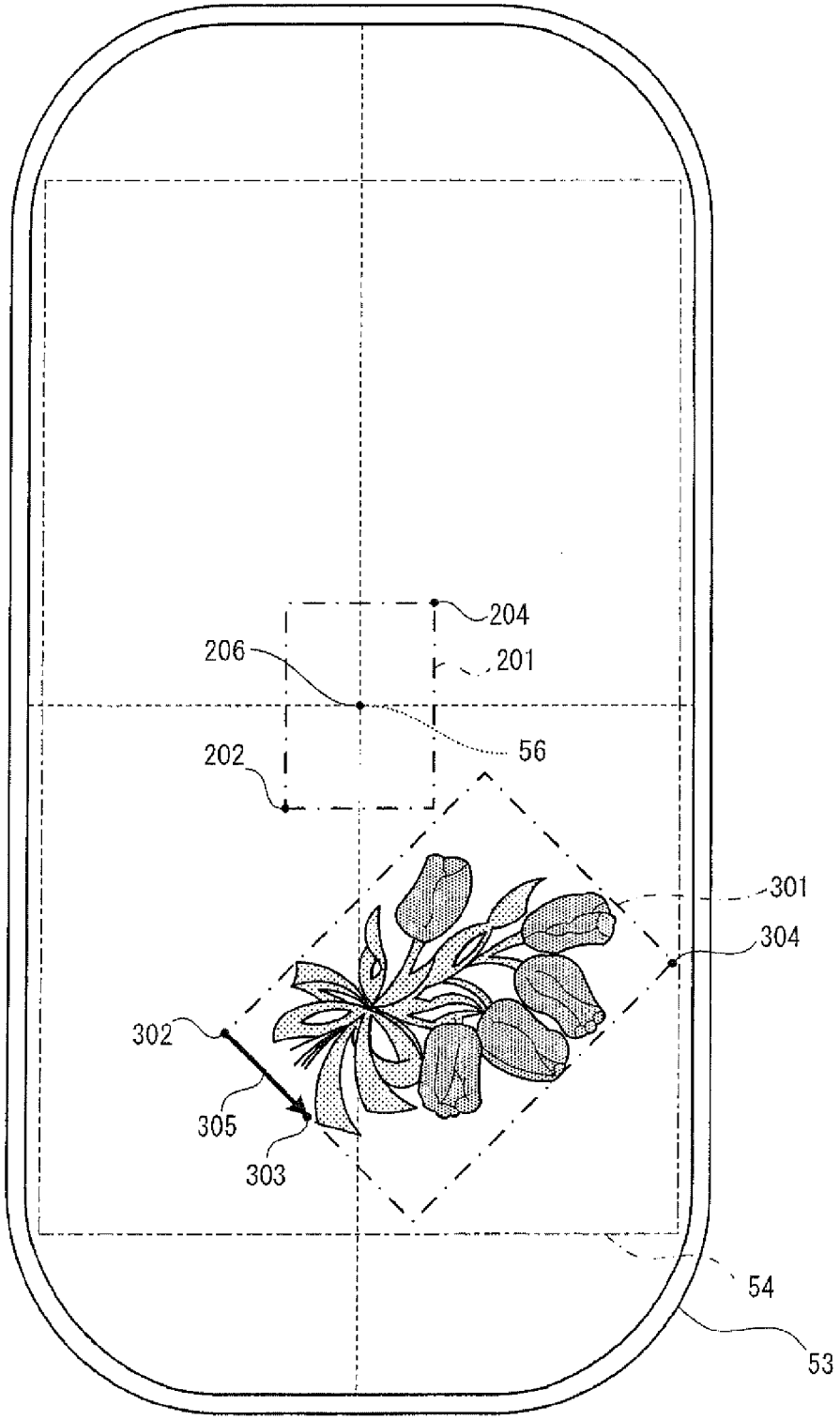
FIG. 10 is an explanatory figure of initial sewing conditions and changed sewing conditions.

A screen 150, the embroidery pattern, and the pattern data for the embroidery pattern will be explained with reference to FIGS. 9 and 10 using an embroidery pattern 200 as an example. The screen 150 in FIG. 9 is a screen that is displayed on the LCD 15 in the course of performing the main processing, which will be described below. By performing a panel operation, the user is able to select a desired embroidery pattern from among a plurality of embroidery patterns that are stored in the EEPROM 64. The screen 150 includes an embroidery pattern display area 151, a thread color display area 152, and a setting screen 153. The embroidery pattern display area 151 displays the selected embroidery pattern 200. The thread color display area 152 displays the colors of the threads to be used for sewing the selected embroidery pattern 200, as well as the times to be required in order to sew the individual colors. The embroidery pattern 200 is an embroidery pattern to be sewn with the threads of the plurality of colors that are shown in the thread color display area 152. The pattern data for sewing the embroidery pattern 200 include coordinate data for an embroidery coordinate system. The embroidery coordinate system is the coordinate system for the X axis motor 86 and the Y axis motor 87 that move the carriage 52. The pattern data define the initial disposition and the initial size of the embroidery pattern. The initial sewing position for the embroidery pattern 200 is set such that a center point 206 of an embroidery area 201 will coincide with a center point 56 of a sewing area 54, as shown in FIG. 10. The embroidery area 201 is the smallest rectangle within which the embroidery pattern 200 can be inscribed. The initial sewing angle for the embroidery pattern 200 is the angle at which the direction of a vector from a point 202 to a point 203 of the embroidery area 201 coincides with the direction from left to right in the embroidery frame 53. The initial size of the embroidery pattern 200 is shown by the size of the embroidery area 201. In a case where the disposition of the embroidery pattern is changed in relation to the sewing workpiece 100, the coordinate data for the embroidery coordinate system that are included in the pattern data are corrected as necessary. In the present embodiment, the embroidery coordinate system and the world coordinate system are correlated with one another in advance. Therefore, based on a command to change the target sewing condition for the embroidery pattern, the command using the designated coordinates that are expressed in the world coordinate system, the sewing machine 1 is able to correct the coordinate data that are expressed in the embroidery coordinate system.

An overview of the main processing that is performed by the sewing machine 1 in the first embodiment will be explained with reference to FIG. 9. The main processing is processing that, as necessary, changes the settings for the target sewing condition for the embroidery pattern selected by the user, based on the designated position on the sewing workpiece 100, then sews the embroidery pattern. In the first embodiment, the target sewing condition is selected one of the sewing position, the sewing angle, and the size of the embroidery pattern. After selecting one of one and two reference items that correspond to the target sewing condition, the user designates the designated position in the specified sequence.

The method for designating the target sewing condition will be explained, using as an example a case in which the embroidery pattern 200 has been selected by the user. First, the user refers to the setting screen 153 and selects a reference item that corresponds to the target sewing condition. The setting screen 153 includes an OK button 381 and a graphic symbol cluster 360 for selecting the reference items for the sewing position, the sewing angle, and the pattern size. The graphic symbol cluster 360 includes points 361 to 364 that indicate the vertices of the embroidery area 201, blocks 371 to 378 that indicate sections of the edges of the embroidery area 201, a plus-sign-and-arrow 379 that indicates the center point of the embroidery area 201 and the sewing angle, and a point 380 that indicates the center point of the embroidery area 201. In a case where the user selects the sewing position as the target sewing condition, the user selects, as the reference item, one point from among the points 361 to 364 and the point 380 in the graphic symbol cluster 360. In a case where the user selects the sewing angle as the target sewing condition, the user selects, as the reference item, one of the blocks 371 to 378 and the plus-sign-and-arrow 379 in the graphic symbol cluster 360. In a case where the user selects the pattern size as the target sewing condition, the user selects, as the reference items, two points from among the points 361 to 364 and the point 380 in the graphic symbol cluster 360. In the first embodiment, the target sewing condition is designated by the particular graphic symbols and the number of the selected graphic symbols. The colors of the graphic symbols that are selected in the graphic symbol cluster 360 are changed. In FIG. 9, the block 371 has been selected, and its color has been changed from white to black. The black block 371 indicates that the target sewing condition is the sewing angle.

Next, the user uses the ultrasonic pen 91 to designate one of one and two designated positions in accordance with the target sewing condition. The sewing position is designated using one designated position. The one designated position indicates the position where the reference item for the sewing position is located. The sewing angle is designated using two designated positions that are respectively called a first designated position and a second designated position. A vector from the first designated position to the second designated position describes a vector direction indicated by the reference item. In a case where a block has been selected as the reference item for the sewing angle, the vector direction indicated by the reference item indicates is the direction in which the block extends, starting from the point, among the points 361 to 364, with which the block is in contact. In a case where the plus-sign-and-arrow 379 has been selected as the reference item for the sewing angle, the vector direction indicated by the reference item is the direction that is indicated by the arrow. The pattern size is designated using the two designated positions that are respectively called the first designated position and the second designated position. The length of a line segment that connects the first designated position and the second designated position indicates the length of a line segment that connects the two points that have been selected as the reference items for the pattern size. In a case where the user uses the ultrasonic pen 91 to change the target sewing condition, the user cannot determine the manner in which the target sewing condition has been changed. Accordingly, the sewing machine 1 projects a marker that indicates the all of the at least one sewing condition for the embroidery pattern onto the sewing workpiece 100, and in a case where the target sewing condition has been changed, the sewing machine 1 reflects the nature of the change in the marker that is projected.

Figure 11:
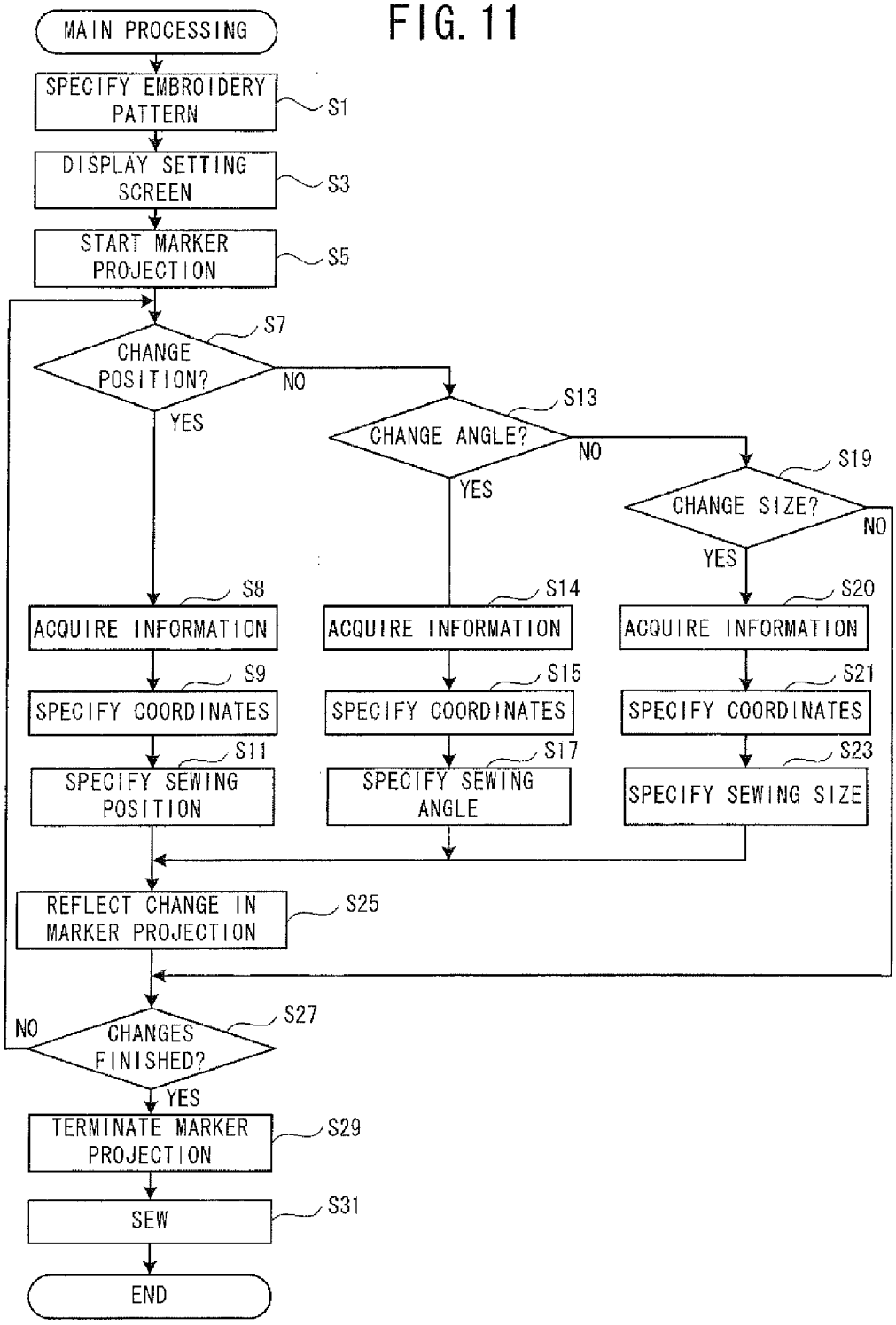
FIG. 11 is a flowchart of main processing.

The main processing will be explained with reference to FIGS. 9 to 12. The main processing in FIG. 11 is performed in a case where, after the user has used a panel operation to select the embroidery pattern, the user uses a panel operation to input a start command. The main processing is started in a state in which the sewing workpiece 100 is being held in the embroidery frame 53 that is mounted in the embroidery device 2. The program that performs the main processing in FIG. 11 is stored in the ROM 62 in FIG. 7 and is executed by the CPU 61. As a specific example, a case will be explained in which the sewing condition for the embroidery pattern 200 that has been selected by the user are changed from the initial sewing conditions that are indicated by the embroidery area 201 to the conditions that are indicated by an embroidery area 301 as shown in FIG. 10.

As shown in FIG. 11, in the main processing, the embroidery pattern 200 selected by the user is specified, the pattern data for sewing the embroidery pattern 200 are acquired from the EEPROM 64, and the acquired pattern data are stored in the RAM 63 (Step S1). The pattern data define the initial sewing conditions for the embroidery pattern 200 as indicated by the embroidery area 201 in FIG. 10. Next, the setting screen 153 is displayed on the LCD 15 (Step S3). In the first embodiment, one of the sewing position, the sewing angle, and the pattern size can be selected at any one time as the target sewing condition for which the settings will be changed.

Figure 12:
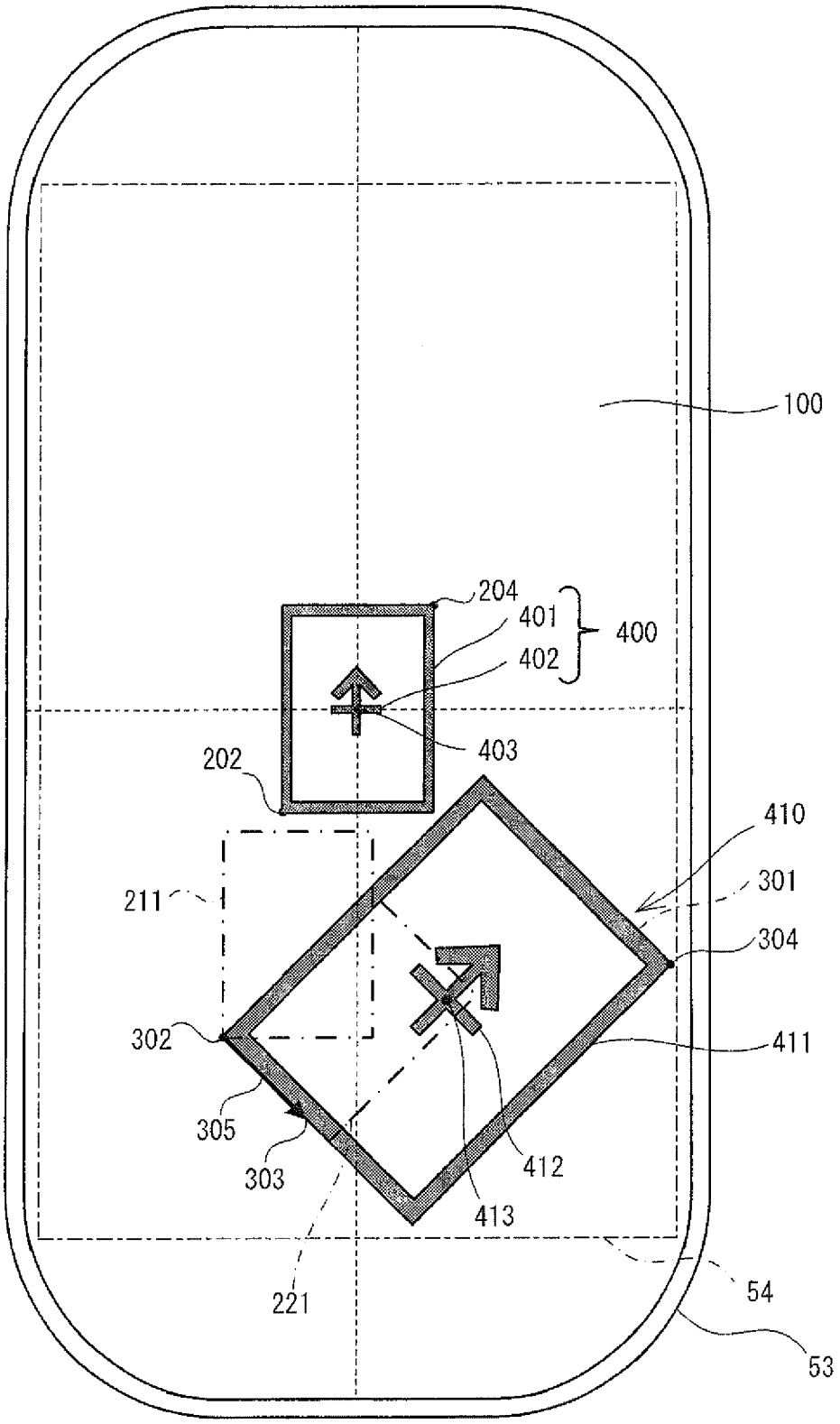
FIG. 12 is an explanatory figure of a marker that is projected onto a sewing workpiece.

Next, the projecting of the marker is started (Step S5). In the processing at Step S5, first, the initial sewing conditions including the initial disposition and the initial size of the embroidery pattern 200 that was specified at Step S1 are specified based on the pattern data. Marker data are then generated for projecting a marker 400 that indicates the specified initial sewing conditions. The marker data are generated by a known method. For example, the marker data may be generated by a method that is described in detail in Japanese Laid-Open Patent Publication No. 2011-194043, relevant portions of which are herein incorporated by reference. The marker 400 indicates all of the plurality of the sewing conditions. The marker 400 includes a marker 401 and a marker 402, as shown in FIG. 12. The marker 401 is a rectangular graphic symbol. The outer perimeter of the marker 401 describes the initial embroidery area 201 (refer to FIG. 10). The marker 402 is a graphic symbol that combines a plus sign and an arrow. An intersection point 403 of the plus sign portion indicates the center point 206 of the embroidery area 201. The direction pointed by the arrow of the marker 402 indicates the direction of the top side of the embroidery pattern 200 (refer to FIG. 9) (the direction from the point 202 to a point 205, refer to FIG. 9). The user confirms the settings for the sewing conditions by visually checking the marker 400 that is projected onto the sewing workpiece 100. In a case where the sewing conditions indicated by the marker 400 are acceptable to the user for sewing the embroidery pattern 200, the user selects the OK button 381 on the setting screen 153 that is displayed on the LCD 15 (YES at Step S27). In a case where the user wants to change the sewing conditions that are indicated by the marker 400 (NO at Step S27), the user selects the target sewing condition for which the user wants to change the settings by making a selection from the graphic symbol cluster 360 that is displayed on the LCD 15.

In a case where the selecting of the point 361 on the setting screen 153 is detected, a determination is made that the sewing position has been selected as the target sewing condition for which the settings will be changed (YES at Step S7), and information that describes the designated position is acquired (Step S8). In the present embodiment, the transmission time T1, the detection time T2*b*, and the detection time T2*c* are acquired as the information that describes the designated position. In a case where the user uses the ultrasonic pen 91 to designate a designated position 302, the signal output circuit 914 of the ultrasonic pen 91 outputs an electrical signal through the cable 912 at the time when the pen tip 911 is pressed against the sewing workpiece 100. At the same time, the ultrasonic transmitter 915 of the ultrasonic pen 91 transmits ultrasonic waves. Through the cable 912, the CPU 61 detects the electrical signal that has been output from the ultrasonic pen 91. The CPU 61 acquires the time that the electrical signal was detected as the transmission time T1. After acquiring the transmission time T1, the CPU 61 detects the ultrasonic waves through the receivers 94, 95. The CPU 61 acquires the times when the ultrasonic waves were detected through the receivers 94, 95 and the input/output interface 65 as the detection times T2*b*, T2*c*, respectively.

Next, the coordinates of the designated position 302 are specified as the coordinates that indicate the sewing position, based on the directionalities of the receivers 94, 95 and the above-described simultaneous equations (Step S9). Next, the sewing position is set for the embroidery pattern based on the coordinates of the designated position 302 specified at Step S9 (Step S11). In the specific example, the point 202 of the embroidery area 201 is disposed at the position indicated by the specified coordinates of the designated position 302. Next, processing is performed that reflects the changed target sewing condition in the projected marker (Step S25). Specifically, based on the coordinates of the designated position 302 that were specified at Step S9, marker data are generated for projecting the marker that shows all of the plurality of the sewing conditions including the changed target sewing condition, and based on the generated marker data, the marker that shows all of the plurality of the sewing conditions including the changed target sewing condition is projected onto the sewing workpiece 100. The marker data may be generated by a known method. For example, the marker data may be generated by the method that is described in detail in Japanese Laid-Open Patent Publication No. 2011-194043, relevant portions of which are herein incorporated by reference. In the specific example, as shown in FIG. 12, the marker 400 is projected onto an embroidery area 211 disposed by parallel translation of the initial embroidery area 201 (Step S25).

After the processing at Step 25, in a case where the selecting of the block 371 on the setting screen 153 is detected (NO at Step S27), a determination is made that the sewing angle has been selected as the target sewing condition for which the settings will be changed (NO at Step S7; YES at Step S13), and information that describes two designated positions is acquired (Step S14). In a case where the user has designated the designated position 302 and a designated position 303 in that order, information that corresponds to the two designated positions is acquired in the form of information that describes the designated position 302, which is the first designated position, and information that describes the designated position 303, which is the second designated position. The first designated position 302 and the second designated position 303 in combination designate the sewing angle. Next, the coordinates for the first designated position 302 and the second designated position 303 are specified by the same method as was used at Step S9 (Step S15). Next, the sewing angle for the embroidery pattern 200 is set based on the coordinates specified at Step S15 (Step S17). In the specific example, as shown in FIG. 12, the embroidery area 211 is rotated about the first designated position 302 such that the direction of the vector from the point 202 to the point 203 (refer to FIG. 9) matches the direction of a vector 305 from the first designated position 302 to the second designated position 303. The embroidery area 211 is thus rotated about the first designated position 302 and becomes an embroidery area 221. In this case, at Step S25, the marker 400 is projected onto the embroidery area 221 (Step S25).

After the processing at Step 25, in a case where the selecting of the point 361 and the point 363 on the setting screen 153 is detected (NO at Step S27), a determination is made that the pattern size has been selected as the target sewing condition for which the settings will be changed (NO at Step S7; NO at Step S13; YES at Step S19), and information that describes two designated positions is acquired (Step S20). In a case where the user has designated the designated position 302 and a designated position 304 in that order, information that corresponds to the two designated positions is acquired in the form of information that describes the first designated position 302 and information that describes the designated position 304, which is the second designated position. The first designated position 302 and the second designated position 304 in combination designate the pattern size. Next, the coordinates for the first designated position 302 and the second designated position 304 are specified by the same sort of method as was used at Step S9 (Step S21). Next, the pattern size for the embroidery pattern 200 is set based on the coordinates specified at Step S21 (Step S23). In the specific example, as shown in FIG. 12, the embroidery area 221 is enlarged such that a point 204 of the embroidery area 201 (refer to FIG. 9) matches the second designated position 304, and the embroidery area 221 becomes an embroidery area 301. In this case, at Step S25, a marker 410 is projected onto the embroidery area 301 (Step S25).

In a case where a target sewing condition for which the settings will be changed is not selected (NO at Step S7; NO at Step S13; NO at Step S19), as well as after Step S25, a determination is made as to whether or not the OK button 381 has been selected (Step S27). In a case where the OK button 381 has not been selected (NO at Step S27), the CPU 61 returns the processing to Step S7. In a case where the OK button 381 has been selected (YES at Step S27), the projecting of the marker is terminated (Step S29). Next, processing is performed that sews the embroidery pattern specified at Step S1 (Step S31). In a case where at least one of the sewing conditions has been changed, the sewing is performed after the pattern data have been modified in accordance with the changed sewing conditions. The main processing is then terminated.

As described above, with the sewing machine 1 in the first embodiment, while preconceiving the finished state and the like of the embroidery pattern 200 to be sewn on the sewing workpiece 100, the user is able to designate the target sewing condition for the embroidery pattern 200 on the sewing machine 1 by designating the position of the pen tip 911 of the ultrasonic pen 91 on the sewing workpiece 100. The designated target sewing condition can be confirmed by looking at the marker 400 that is projected onto the sewing workpiece 100. In the sewing machine 1, the position on the sewing workpiece 100 can be designated using the ultrasonic pen 91. The designated position and the position where the marker is projected are both on the sewing workpiece 100. Therefore, the user can check the designation status of the designated position more easily than in a case where the designated position and the marker are far apart.

The sewing machine 1 is able to set one of the sewing position, the sewing angle, and the pattern size of the embroidery pattern as the target sewing condition at once. In a case where the sewing position is selected as the target sewing condition, the sewing machine 1 can set the sewing position for the embroidery pattern based on one specified designated position. Therefore, by the simple operation of designating a point that corresponds to a reference item, the user can accomplish the task of disposing the embroidery pattern 200 to the right of another pattern on the sewing workpiece 100, for example. In a case where the sewing angle is selected as the target sewing condition, the sewing machine 1 can set the sewing angle for the embroidery pattern based on two specified designated positions. Using the designated positions, the sewing machine 1 is able to designate the extending direction of any side of the rectangular embroidery area 201 for the embroidery pattern 200. Therefore, by the simple operation of designating two points that correspond to the reference items, the user can accomplish the task of disposing the embroidery pattern 200 along a stripe of a striped pattern on the sewing workpiece 100, for example. In a case where the pattern size is selected as the target sewing condition, the sewing machine 1 can set the size of the embroidery pattern based on two specified designated positions. Therefore, by the simple operation of designating two points that correspond to the reference items, the user can accomplish the task of disposing the embroidery pattern 200 such that it fills an entire rectangular pattern area on the sewing workpiece 100, for example.

The marker 400 projected by the sewing machine 1 shows all of the plurality of the sewing conditions. By looking at the marker 400 that is projected onto the sewing workpiece 100, the user can easily determine the designation statuses of all of the plurality of the sewing conditions. The target sewing condition that has been changed is immediately fed back to the marker 400 that is being projected. While checking the marker 400 that is projected onto the top face of the sewing workpiece 100, the user can easily perform fine adjustments of the sewing conditions by using the ultrasonic pen 91 to designate a designated position. Fine adjustments of the sewing conditions are easy, particularly because the sewing machine 1 is able to change the settings for one sewing condition among the plurality of the sewing conditions. The sewing machine 1 uses the setting screen 153 to accept the selection of the reference items when the target sewing condition is to be changed. The sewing machine 1 can therefore make it more convenient to change the target sewing condition than in a case where the reference items cannot be selected. Therefore, the user can easily set the target sewing condition.

The main processing in the second embodiment will be explained with reference to FIGS. 9 to 12. The main processing in the second embodiment is basically the same as the main processing in the first embodiment that is shown in FIG. 11. In the second embodiment, the method for designating the at least one target sewing condition is different from the method in the first embodiment. The main processing in the second embodiment is started in a state in which the sewing workpiece 100 is being held in the embroidery frame 53 that is mounted in the embroidery device 2. The program that performs the main processing in FIG. 11 is stored in the ROM 62 in FIG. 7 and is executed by the CPU 61. As a specific example, a case will be explained in which the sewing conditions for the embroidery pattern 200 that has been selected by the user are changed from the initial sewing conditions that are indicated by the embroidery area 201 in FIG. 10 to the conditions that are indicated by the embroidery area 301 in FIG. 10.

First, the method for designating the at least one target sewing condition in the second embodiment will be explained. In the second embodiment, the at least one target sewing condition for which the settings will be changed is determined according to the number of designated positions that are designated within a specified period of time (for example, thirty seconds). In a case where one designated position is designated, the sewing position is specified as the at least one target sewing condition for which the settings will be changed. In that case, the sewing position is set using the designated position that has been designated. The method for using the designated position to set the sewing position is the same as in the first embodiment. In a case where two designated positions are designated, the sewing position and the sewing angle are specified as the at least one target sewing condition for which the settings will be changed. In that case, the two designated positions are specified as the first designated position and the second designated position in the order in which they are input. Further, the first designated position is used to set the sewing position. The first designated position and the second designated position are used to set the sewing angle. The method for using the first designated position and the second designated position to set the sewing angle is the same as in the first embodiment. In a case where three designated positions are designated, the sewing position, the sewing angle, and the pattern size are specified as the at least one target sewing condition for which the settings will be changed. In that case, the three designated positions are specified as the first designated position, the second designated position, and a third designated position in the order in which they are input. Further, the first designated position is used to set the sewing position. The first designated position and the second designated position are used to set the sewing angle. The first designated position and the third designated position are used to set the pattern size. The method for using the designated positions to set the pattern size is the same as in the first embodiment. The reference items for each of the at least one target sewing condition can be set using the setting screen 153, in the same manner as in the first embodiment. The sewing machine 1 in the second embodiment makes the initial settings for the reference items automatically, but gives priority to the user's instruction in a case where a setting for a reference item is designated by the user. The initial setting for the reference item for the sewing position is the point 361. The reference item for the sewing angle is the block 371. The reference items for the pattern size are the point 361 and the point 363.

Next, the main processing in the second embodiment, which is shown in FIG. 11, will be explained briefly. In the main processing, after the embroidery pattern has been specified (Step S1), the setting screen 153 in FIG. 9 is displayed (Step S3). In the same specific example as was used for the first embodiment, assume a case in which the designated positions 302 to 304 are designated in order within a specified period of time, in accordance with the initial settings for the reference items. In this case, the designated positions 302 to 304 are respectively specified as the first designated position 302, the second designated position 303, and the third designated position 304. After the projecting of the marker 400 is started (Step S5), the information that describes the first designated position 302 is acquired (YES at Step S7; Step S8), and the coordinates of the first designated position 302 are specified based on the acquired information (Step S9). Based on the specified first designated position 302 and on the point 361 that is the reference item for the sewing position, the sewing position is set such that the position of the point 202 of the embroidery area 201 is disposed at the coordinates of the first designated position 302 (Step S11). After the change in the sewing position is reflected in the marker that is being projected (Step S25), a determination is made that the change of the at least one target sewing conditions has not been completed (NO at Step S27). Next, a determination is made that the setting of the sewing position has been completed (NO at Step S7), and the information that describes the first designated position 302 and the information that describes the second designated position 303 are acquired (YES at Step S13; Step S14). Based on the acquired information, the coordinates for the first designated position 302 and the second designated position 303 are specified (Step S15), and the sewing angle is set based on the vector from the first designated position 302 to the second designated position 303 and on the block 371, which is the reference item for the sewing angle (Step S17). After the change in the sewing angle is reflected in the marker that is being projected (Step S25), a determination is made that the change of target sewing conditions has not been completed (NO at Step S27).

Next, a determination is made that the settings of the sewing position and the sewing angle have been completed (NO at Step S7; NO at Step S13), and the information that describes the first designated position 302 and the information that describes the third designated position 304 are acquired (YES at Step S19; Step S20). Based on the acquired information, the coordinates for the first designated position 302 and the third designated position 304 are specified (Step S21). The pattern size is set such that the length of a line segment that connects the first designated position 302 and the third designated position 304 becomes the length of a line segment that connects the point 361 and the point 363, which are the reference items for the pattern size (Step S23). The change in the pattern size is reflected in the marker that is being projected (Step S25). In a case where the designating of a designated position is not detected within the specified period of time (NO at Step S7; NO at Step S13; NO at Step S19), as well as after Step S25, if the OK button 381 has been selected (YES at Step S27), the projecting of the marker is terminated (Step S29), and the sewing of the pattern is performed (Step S31). If the OK button 381 has not been selected (NO at Step S27), the CPU 61 returns the processing to Step S7.

As described above, according to the sewing machine 1 in the second embodiment, the same sort of effects as those of the sewing machine 1 in the first embodiment can be achieved by the designating of the position of the pen tip 911 of the ultrasonic pen 91 on the sewing workpiece 100. The sewing machine 1 in the second embodiment selects the at least one target sewing condition to be changed, based on the number of the designated positions, so the time and effort for the user to select the at least one target sewing condition using panel operations can be eliminated. The plurality of the at least one target sewing condition can all be set at once by the series of operations by which one of one, two, and three designated positions are designated.

The sewing machine according to the present disclosure is not limited to the embodiments described above, and various types of modifications may be made. For example, the modifications (A) to (E) described below may be made as desired.

(A) The configuration of the sewing machine 1 may be modified as desired. The sewing machine may also be another type of sewing machine, such as an industrial sewing machine, a multi-needle sewing machine, or the like, for example. The sewing machine may also be a sewing machine that is not provided with an embroidery device, for example. The sewing machine may also be a sewing machine configured as a single device integrated with an embroidery device, for example. The sewing workpiece may be any object in which a stitch can be formed. The sewing machine may also be provided with a device (a position designating device) that designates the designated position, which may be any position on the sewing workpiece, and the sewing machine and the position designating device may also be separate devices, as with the sewing machine 1.

(B) The information that describes the designated position and the method for acquiring the information may be modified as desired. The method for specifying the designated position may also be modified in accordance with the information that is acquired. For example, image data that are acquired from an image capture device such as an image sensor or the like may also be acquired through the input/output interface 65 as the information that describes the designated position. A known method may also be used as desired as the method for specifying the designated position based on the image data. For example, the designated position may be specified based on the image data by a method that is described in detail in Japanese Laid-Open Patent Publication No. 2011-194043, relevant portions of which are herein incorporated by reference. To take another example, data that are output from a graphics tablet may also be acquired through the input/output interface 65 as the information that describes the designated position. In a case where the designated position is designated using an ultrasonic pen, times that are detected by at least three receivers with specified mounting positions, for example, may also be acquired as the information that describes the designated position. In that case, the sewing machine is able to specify the designated position based on the directionalities of the individual receivers and on the same sort of simultaneous equations as the above-described Equations (5) and (6), with the number of the equations being equal to the number of the receivers. To take still another example, the information that describes the designated position may also be acquired wirelessly.

(C) The design, the shape, the size, and the like of the marker may also be modified as desired in consideration of the conditions indicated by the marker. For example, in a case where the marker indicates the sewing position, the marker may be one of a plus sign, a circle, and a star shape. The content that the marker indicates may also be content other than the sewing conditions for the embroidery pattern. In that case, the marker may also be projected in order to calibrate the projector, for example. More specifically, processing that adjusts the adjusting screws 44 or corrects the parameters that are used in the generating of the image data may be performed such that the marker will be projected at the position that is designated by the ultrasonic pen 91. In a case where a plurality of the target sewing conditions are set based on the designated positions, it is acceptable for the marker not to indicate all of the plurality of the target sewing conditions. For example, in a case where the sewing position, the sewing angle, and the pattern size are set as the target sewing conditions for the embroidery pattern, the marker may indicate only the pattern size.

(D) The projection device that projects the marker is not limited to being the above-described projector, and it may be modified as desired. For example, the projection device may be at least one of a laser line marker and a laser pointer. The projection device may also be configured such that it can be removably mounted on the sewing machine, for example. The projection device may also be a separate device from the main body of the sewing machine, for example. The projection device may also be configured such that its mounting position can be changed, for example. The projection range of the projection device may also be modified as desired. For example, in a case where the pattern size is set based on the coordinates of the designated positions, the marker is not necessary in order to indicate the sewing position for the embroidery pattern, so it is not necessary for the projection range to include the sewing area 54 of the embroidery frame 53. To take another example, it is not necessary for the projector to reflect the content of a sewing condition change in the marker that is being projected every time the target sewing condition is changed. For example, the sewing machine may also reflect the content of a change in the marker that is being projected only when a command to reflect the content of the change is received from the user. To take another example, the sewing machine 1 in the second embodiment may also reflect the content of a change in the marker that is being projected in a case where a plurality of the target sewing conditions have been set based on designated positions designated by a series of operations that designated at least two designated positions. The location where the marker is projected may also be set based on a designated position, taking into consideration the content that is indicated by the marker. For example, in the first and second embodiments, in a case where the sewing position is set based on a designated position, the position where a plus-sign-and-arrow that indicates the sewing position at the center of the embroidery pattern is projected may be the same as the designated position, and it may be different from the designated position.

(E) The method for setting the at least one target sewing condition for the embroidery pattern based on at least one designated positions may be modified as desired. For example, in a case where the sewing position is designated using designated positions, a reference point for the embroidery pattern may be disposed at the coordinates of the center point between two designated positions. To take another example, the sewing position, the sewing angle, and the pattern size may also be set based on two designated positions. In that case, the individual conditions may be set as hereinafter described, for example. The sewing position is set based on one of the two designated positions. The sewing angle is set based on the direction of a vector from one of the designated positions to the other of the designated positions. The size of the embroidery pattern is set based on the length of a line segment that connects the two designated positions. In a sewing machine that is capable of setting a plurality of sewing conditions, processing may be used in which a single designated position sets one target sewing condition, as in the sewing machine 1 in the first embodiment, and processing may be used in which a single designated position sets each one of a plurality of target sewing conditions, as in the sewing machine 1 in the second embodiment.

To take another example, the main processing in the first embodiment and the main processing in the second embodiment may be combined to make the following two modes available. A first mode in which a plurality of target sewing conditions can be changed at once, based on a plurality of designated positions, and a second mode in which only specific one target sewing condition can be changed can both be selected. In that case, the user may designate the sewing conditions approximately by changing a plurality of the target sewing conditions at once based on a plurality of designated positions. The user may then perform fine adjustment of the sewing conditions by changing only specific one target sewing condition. Taking another example, in a case where a plurality of the target sewing conditions are set based on a plurality of designated positions, at least one of the sewing angle and the pattern size may be set in addition to the sewing position. For example, the sewing position and the pattern size may be set based on two designated positions. It is also acceptable for the sewing machine 1 not to accept resetting of the at least one target sewing condition. In that case, the sewing machine 1 determines, at Step S27 in FIG. 11, that the change has been completed in a case where the processing that sets the target sewing condition based on the one or two designated positions has been completed one time (YES at Step S27), and then performs the processing at Step S29. In a case where a plurality of the sewing conditions are set based on a plurality of designated positions, the relation between the designated positions and the target sewing conditions to be set may be made as desired. The sewing condition for the embroidery pattern may also be any condition other than the sewing position, the sewing angle, or the pattern size. For example, an amount of deformation in the embroidery pattern may also be set as a sewing condition for the embroidery pattern, based on the designated position.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a position acquisition device configured to acquire information describing at least one designated position, each of the at least one designated position being a position on a sewing workpiece;

a projection device configured to project an image onto the sewing workpiece;

a sewing device configured to form a stitch in the sewing workpiece;

a processor; and a memory configured to store non-transitory computer-readable instructions that instruct the processor to execute the steps of:

specifying an embroidery pattern to be sewn on the sewing workpiece;

specifying the at least one designated position on the sewing workpiece described by the information acquired by the position acquisition device;

setting at least one condition for sewing the specified embroidery pattern, based on the specified at least one designated position;

causing the projection device to project a visually recognizable marker onto the sewing workpiece, based on the specified at least one designated position, the marker indicating that the at least one condition that has been set; and causing the sewing device to sew the specified embroidery pattern on the sewing workpiece, based on the at least one condition that has been set.

2. The sewing machine according to claim 1, wherein the setting of the at least one condition includes setting a sewing position for the embroidery pattern as one of the at least one condition, based on the specified at least one designated position.

3. The sewing machine according to claim 2, wherein the setting of the at least one condition, in a case where a plurality of the at least one designated position have been specified, includes setting at least one of an angle and a size for the specified embroidery pattern as one of the at least one condition, in addition to the sewing position for the specified embroidery pattern.

4. The sewing machine according to claim 1, wherein the causing of the projection device to project the marker onto the sewing workpiece, in a case where a plurality of the at least one condition have been set, includes causing the projection device to project onto the sewing workpiece a marker indicating all of the plurality of the at least one condition having been set.

5. The sewing machine according to claim 1, wherein the computer-readable instructions further include instructions that instruct the processor to execute the steps of:

resetting the at least one condition for the embroidery pattern in a case where the at least one designated position has been changed; and causing the projection device, in a case where the at least one designated position has been changed, to project a marker indicating the at least one condition that has been reset, based on the specified designated position that has been changed.

6. A non-transitory computer-readable medium storing computer-readable instructions that, when executed, cause a processor of a sewing machine to perform the steps of:

specifying an embroidery pattern to be sewn on a sewing workpiece;

specifying at least one designated position on the sewing workpiece described by information acquired by a position acquisition device of the sewing machine, the position acquisition device being configured to acquire the information describing the designated position, each of the at least one designated position being a position on a sewing workpiece;

setting at least one condition for sewing the specified embroidery pattern, based on the specified at least one designated position;

causing a projection device provided to the sewing machine to project a visually recognizable marker onto the sewing workpiece, based on the specified at least one designated position, the projection device being configured to project an image onto the sewing workpiece and the marker indicating that the at least one condition that has been set; and causing a sewing device to sew the specified embroidery pattern on the sewing workpiece, based on the at least one condition that has been set, the sewing device being configured to form a stitch in the sewing workpiece.

7. The non-transitory computer-readable medium according to claim 6, wherein the setting of the at least one condition includes setting a sewing position for the embroidery pattern as one of the at least one condition, based on the specified at least one designated position.

8. The non-transitory computer-readable medium according to claim 7, wherein the setting of the at least one condition, in a case where a plurality of the at least one designated position have been specified, includes setting at least one of an angle and a size for the specified embroidery pattern as one of the at least one condition, in addition to the sewing position for the specified embroidery pattern.

9. The non-transitory computer-readable medium according to claim 6, wherein the causing of the projection device to project the marker onto the sewing workpiece, in a case where a plurality of the at least one condition have been set, includes causing the projection device to project onto the sewing workpiece a marker indicating all of the plurality of the at least one condition having been set.

10. The non-transitory computer-readable medium according to claim 6, wherein the computer-readable instructions further cause the sewing machine to perform the steps of:

resetting the at least one condition for the embroidery pattern in a case where the at least one designated position has been changed; and causing the projection device, in a case where the at least one designated position has been changed, to project a marker indicating the at least one condition that has been reset, based on the specified designated position that has been changed.

* * * * *